US006051812A

United States Patent [19]

Walker

[11] Patent Number: 6,051,812

[45] Date of Patent: Apr. 18, 2000

[54] SNOW AND ICE MELTING BLANKET DEVICE

[76] Inventor: Lawrence Walker, 157 Herbert Ave., Elmont, N.Y. 11003

[21] Appl. No.: 09/193,267

[22] Filed: Nov. 16, 1998

[51] Int. Cl.[7] ..... H05B 3/20

[52] U.S. Cl. ..... 219/213; 219/528; 219/548

[58] Field of Search ..... 219/212, 213, 219/528, 529, 548, 549, 520

[56] References Cited

U.S. PATENT DOCUMENTS

| | | | |
|---|---|---|---|
| 2,617,005 | 11/1952 | Jorgensen | 219/19 |
| 2,844,696 | 7/1958 | Custer, Jr. | 219/19 |
| 3,417,229 | 12/1968 | Stomphe et al. | 219/528 |
| 3,806,702 | 4/1974 | Spencer | 219/528 |
| 4,247,756 | 1/1981 | Cucinotta et al. | 219/528 |
| 4,794,228 | 12/1988 | Braun, Jr. | 219/415 |
| 4,967,057 | 10/1990 | Bayless et al. | 219/213 |
| 5,380,988 | 1/1995 | Dyer | 219/548 |

FOREIGN PATENT DOCUMENTS

| | | |
|---|---|---|
| 6-188069 | 7/1994 | China . |

*Primary Examiner*—Tu Ba Hoang
*Assistant Examiner*—Leonid Fastovsky
*Attorney, Agent, or Firm*—Michael I. Kroll

[57] ABSTRACT

A snow and ice melting blanket device positioned on a surface and connected to a power source for melting snow and ice accumulating atop the surface. The snow and ice melting blanket device includes a tarpaulin including a top layer, a bottom layer and a third conductive middle layer positioned between the top and bottom layers. A device for sensing a temperature of the tarpaulin is connected to the tarpaulin. A sensing device is connected between the conductive middle layer and the power source for sensing a weight of snow and ice accumulated atop the tarpaulin. The sensing device acts to connect the power source to supply an electrical charge to the conductive middle layer upon sensing a predetermined weight of snow and ice accumulated atop the tarpaulin causing the conductive middle layer and tarpaulin to heat up and melt the accumulated snow and ice thereby keeping the tarpaulin free of snow and ice. The tarpaulin is formed of a flexible material and thus able to conform to a terrain of the surface desired to be maintained free of accumulating snow and ice. A platform having a top side is positioned below the tarpaulin, wherein the top side is arced causing the tarpaulin to conform to the arc shape and any snow and ice melted by the tarpaulin to flow down along and off of the tarpaulin. The melted snow and ice may be directed away from the surface by gutters positioned on the sides of the tarpaulin.

11 Claims, 10 Drawing Sheets

SNOW AND ICE MELTING BLANKET DEVICE

BACKGROUND OF THE INVENTION

1. Field of the Invention

The present invention relates generally to heating pads and, more specifically, to a device for melting snow and ice accumulating on a rooftop surface and collecting the resulting liquid for removal from the surface of the roof.

2. Description of the Prior Art

Numerous devices for heating a surface have been provided in the prior art. For example, U.S. Pat. Nos. 2,617,005; 2,844,696; 3,806,702; 4,247,756; 4,794,228; 4,967,057 and 5,380,988 Japanese Patent No. 188,069 all are illustrative of such prior art. Thus, while these units may be suitable for the particular purpose to which they address, they would not be as suitable for the purposes of the present invention as heretofore described.

U.S. Pat. No. 2,617,005 relates to a warming device and it is primarily an object of the invention to provide a warming device adapted for use by animals. The device is in the nature of a bed including electrical heating means having a normally open operating circuit together with means whereby the weight of the animal occupying the device effects the closing of the circuit.

U.S. Pat. No. 2,844,696 relates to heating devices and more particularly to a snow melting mat. This device is for use on steps, entrances to buildings, on walks or the like so as to remove snow and ice therefrom by melting and thereby reducing the possibility of accidents occurring.

U.S. Pat. No. 3,806,702 discloses a weatherproof electrically insulative mat having an electrical heat producing conductor therein and adapted for placement on an exterior surface to prevent accumulation of snow on such surface. A control system for supplying current to the conductor including a precipitation sensor, a temperature sensor and a control unit responsive to the sensors so that power is supplied to the conductor in the mat only when there is precipitation and the temperature is below 35°. An improved mat structure that is approximately symmetrical of the central plane thereof so that when one side of the mat wears the mat can be reversed.

U.S. Pat. No. 4,247,756 discloses a heated rubber mat comprising upper and lower rubber panels and an intervening carbon-loaded electrically resistive rubber heating element. All are vulcanized together to form a unitary mat structure characterized by good flexibility permitting rolling up the mat in any direction and by permanent shape retention, said heating element having spaced, flexible electrodes fully enclosed therein and bonded thereto, along with associated, thermostatically controlled current receiving means, whereby current may be transmitted through the portions of the heating element lying between said electrodes to generate heat and whereby the mat may be maintained at the desired temperature.

U.S. Pat. No. 4,967,057 discloses individual electrically heated mats, self-regulated by use of an electrical element whose resistance varies proportionately with its temperature, used for covering walking areas to prevent accumulation of snow and ice. Each mat is provided with male and female electrical connections on the ends of short power cords to permit any number of mats to be chained together in electrical parallel and to be used to cover, for example, a flight of stairs by positioning one mat on each stair.

U.S. Pat. No. 5,380,988 discloses a heated mat structure provides a plurality of thin heated mats, each releasably interconnected in electrical parallel through an electrical powering system providing low voltage current. Each heated mat comprises relatively thin rectilinear laminated structure, having a rigid back panel with fastening means for positional maintenance, supporting a thin heating lamina having an element formed of electrically resistive metallic foil imbedded in plastic sheet material which in turn supports an outer surfacing lamina having an exposed surface of high friction material to prevent slipping. The laminae may carry plastic sheet material between adjacent surfaces and about peripheral edges to aid interconnection and isolation. All adjacent structural surfaces are mechanically joined. Each pad provides an electrical connector communicating spacedly from interconnection with its foil heating element. Each electrical connector is of the vampire type that may be releasably interconnected at selected positions along an elongate two-wire conductor to allow various modular arrays of plural heating mats about that conductor. The electrical system is powered by ordinary household current.

Japanese Patent No. 188,069 discloses a de-icing device for use with roof of building to remove snow therefrom. The device has temperature and weight sensors for controlling a power source supplying an RF current to several induction heating type coils.

SUMMARY OF THE PRESENT INVENTION

The present invention relates generally to heating pads and, more specifically, to a device for melting snow and ice accumulating on a rooftop surface and collecting the resulting liquid for removal from the surface of the roof.

A primary object of the present invention is to provide a snow and ice melting blanket device that will overcome the shortcomings of the prior art devices.

Another object of the present invention is to provide a snow and ice melting blanket device for placement atop a flat roof of a building to melt and remove any snow and/or ice accumulating thereon.

An additional object of the present invention is to provide a snow and ice melting blanket device including a platform having a slanting or arcing surface positioned beneath the heating blanket providing a surface along which any melted liquid will flow due to the force of gravity for eventual collection and removal.

A further object of the present invention is to provide a snow and ice melting blanket device including a gutter positioned on either side of the platform for receiving the melted liquid flowing along the blanket surface and directing the liquid away from the roof surface.

A yet further object of the present invention is to provide a snow and ice melting blanket device able to protect and extend the life of the surface of a roof by removing the melted snow and ice therefrom thereby avoiding any possibility of the melted snow and ice leaking through the rooftop or providing excess weight atop the roof.

A still further object of the present invention is to provide a snow and ice melting heating device that is simple and easy to use.

A still further object of the present invention is to provide a snow and ice melting blanket device that is economical in cost to manufacture.

Further objects of the invention will appear as the description proceeds.

A snow and ice melting blanket device positioned on a surface and connected to a power source for melting snow and ice accumulating atop the surface. The snow and ice melting blanket device includes a tarpaulin including a top layer, a bottom layer and a third conductive middle layer positioned between the top and bottom layers. A device for sensing a temperature of the tarpaulin is connected to the tarpaulin. A sensing device is connected between the conductive middle layer and the power source for sensing a weight of snow and ice accumulated atop the tarpaulin. The sensing device acts to connect the power source to supply an electrical charge to the conductive middle layer upon sensing a predetermined weight of snow and ice accumulated atop the tarpaulin causing the conductive middle layer and tarpaulin to heat up and melt the accumulated snow and ice thereby keeping the tarpaulin free of snow and ice. The tarpaulin is formed of a flexible material and thus able to conform to a terrain of the surface desired to be maintained free of accumulating snow and ice. A platform having a top side is positioned below the tarpaulin, wherein the top side is arced causing the tarpaulin to conform to the arc shape and any snow and ice melted by said tarpaulin to flow down along and off of said tarpaulin. The melted snow and ice may be directed away from the surface by gutters positioned on the sides of the tarpaulin.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 2:
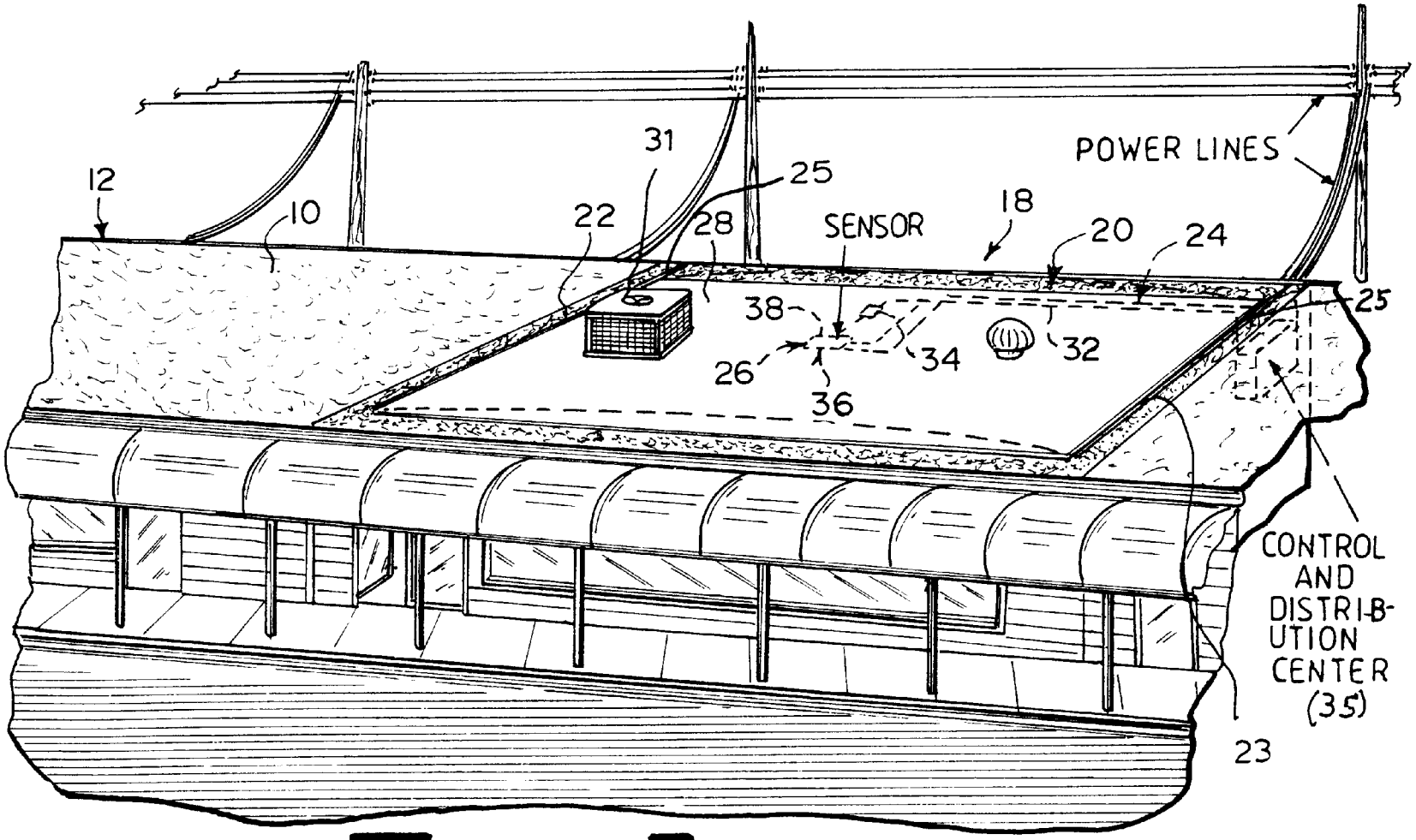
FIG. 2 is a perspective view of the snow and ice melting blanket device of the present invention installed atop a flat roof of a building.
Figure 2A:
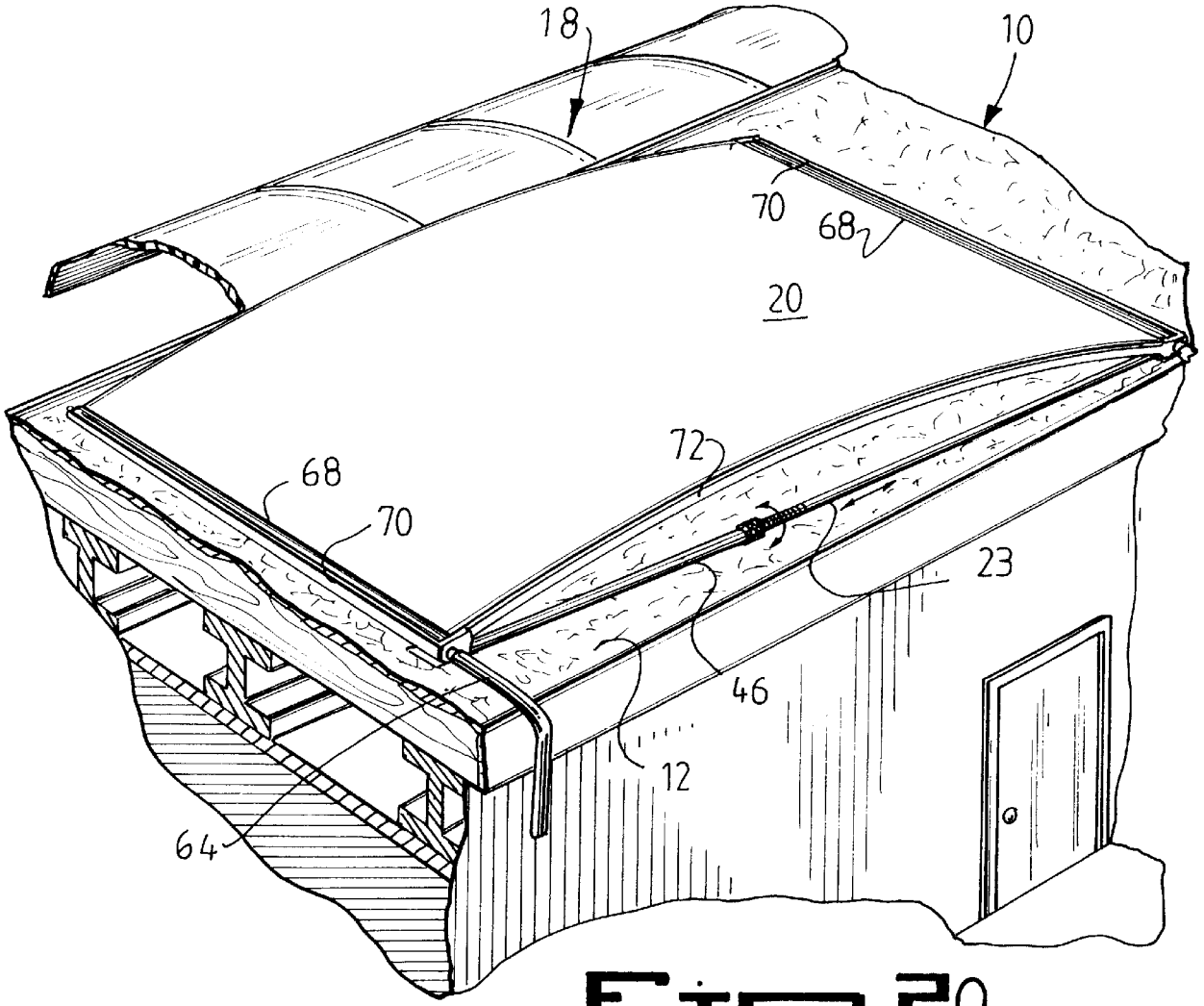
Figure 2B:
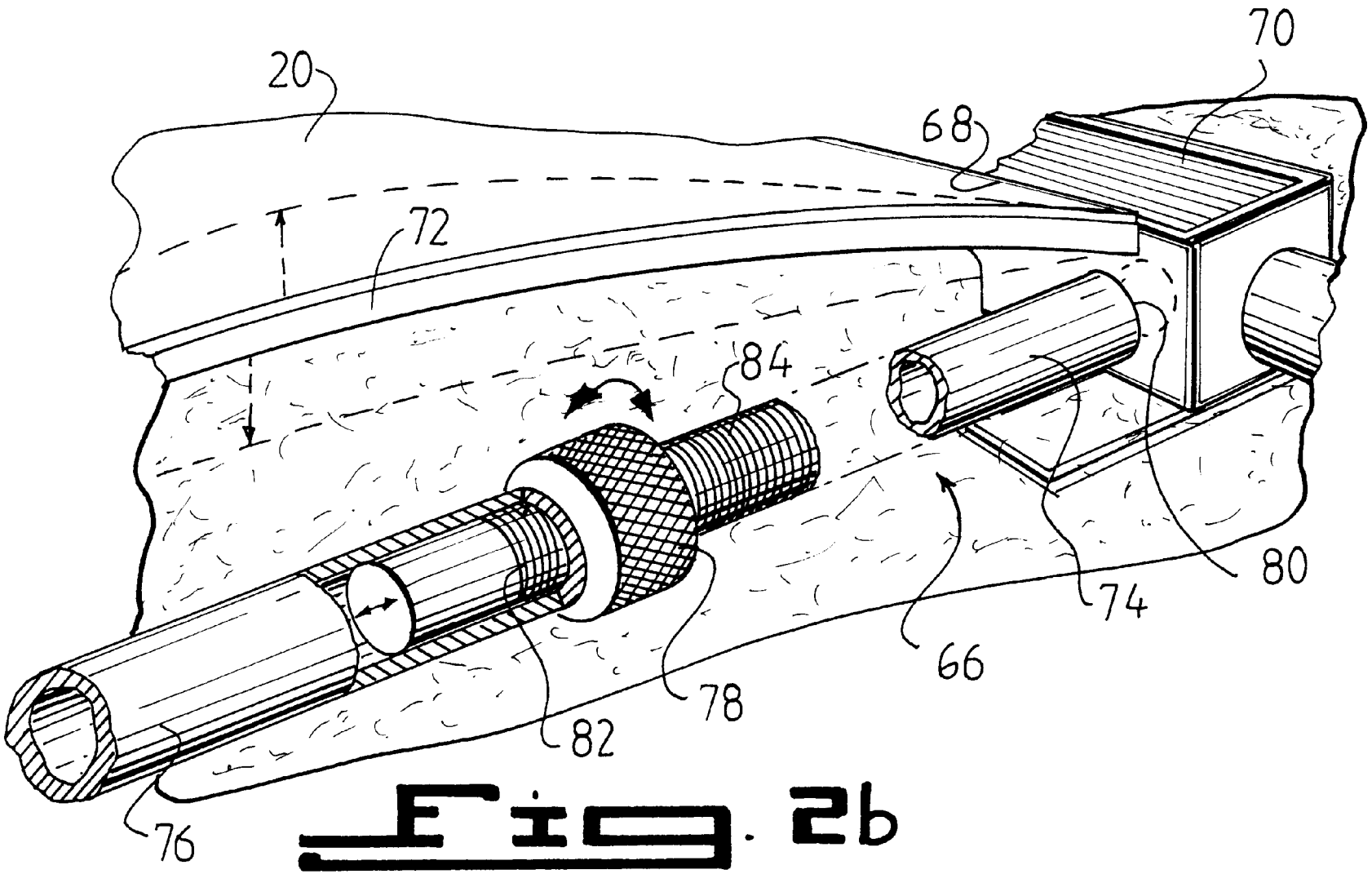
Figure 2C:
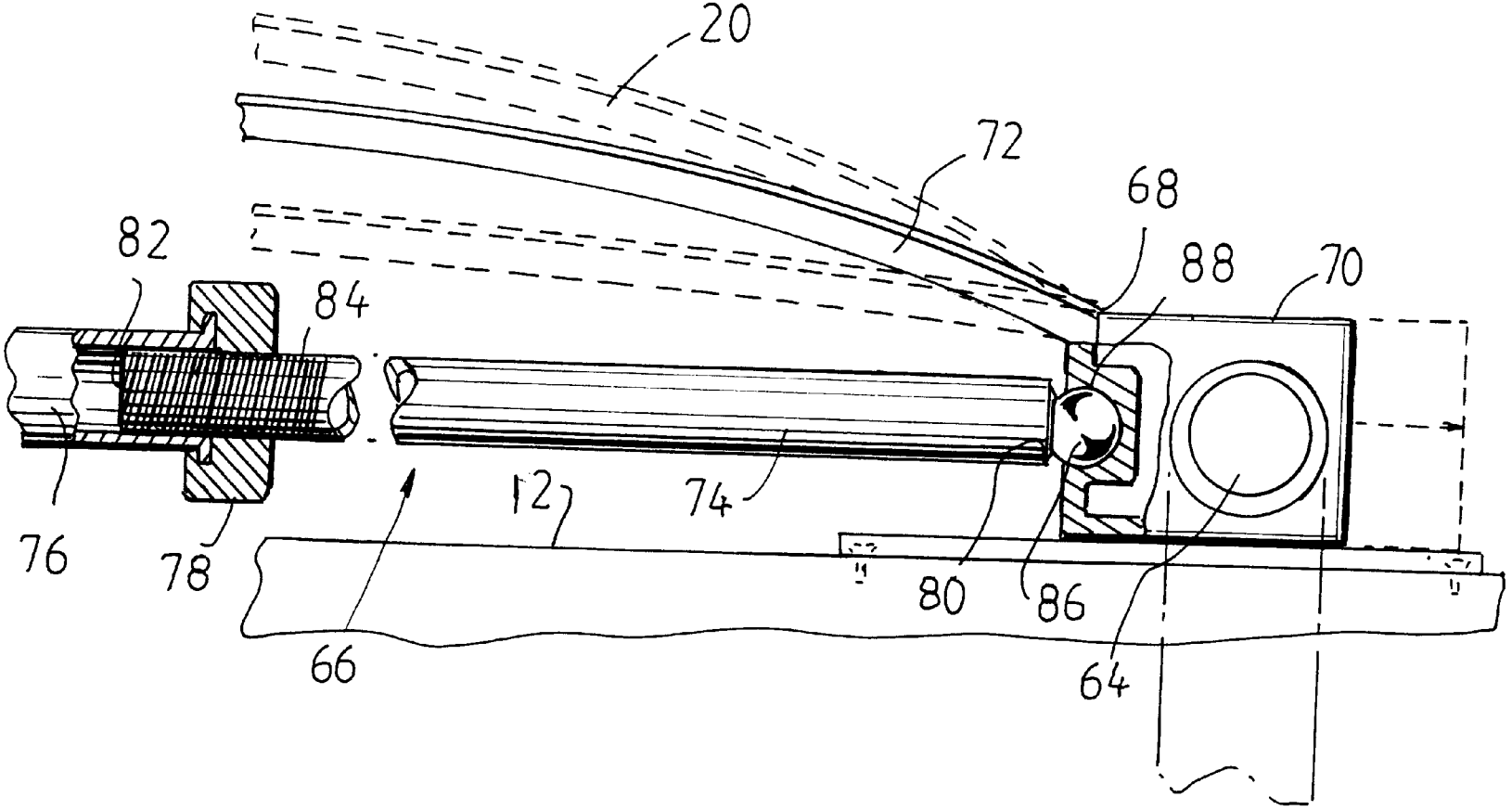
Figure 5:
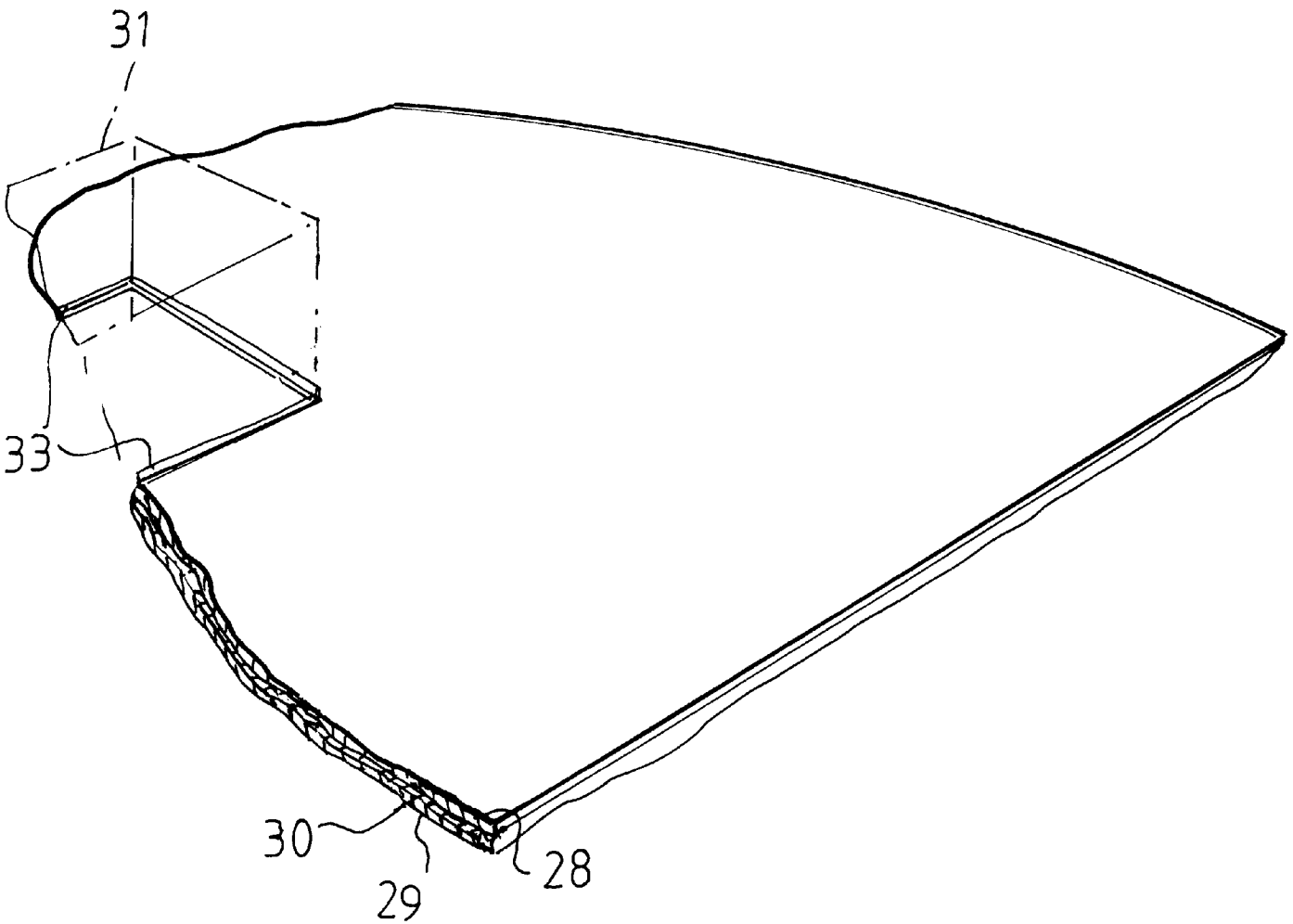
Figure 3:
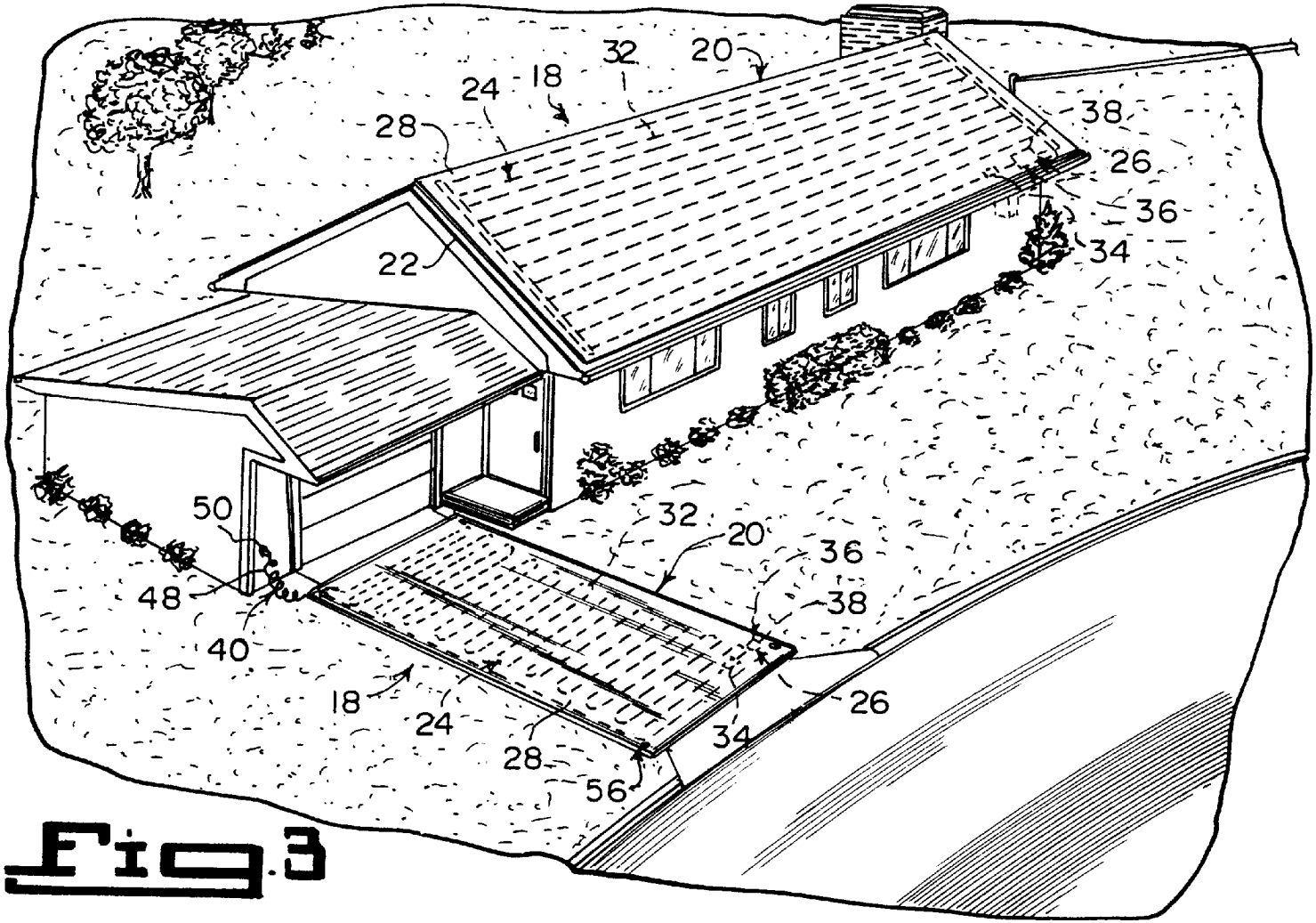
Figures 4, 5, 6:
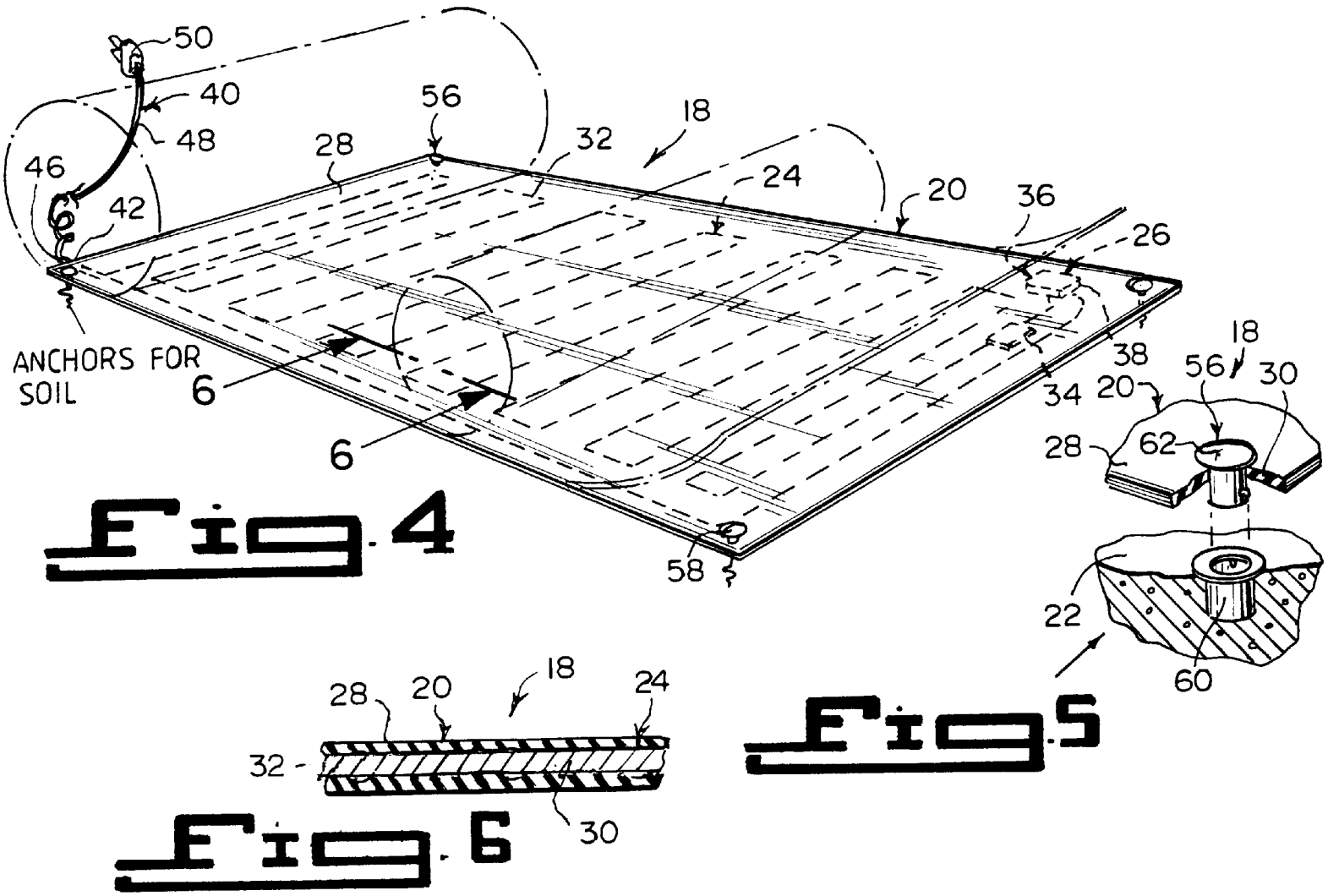
Figure 7:
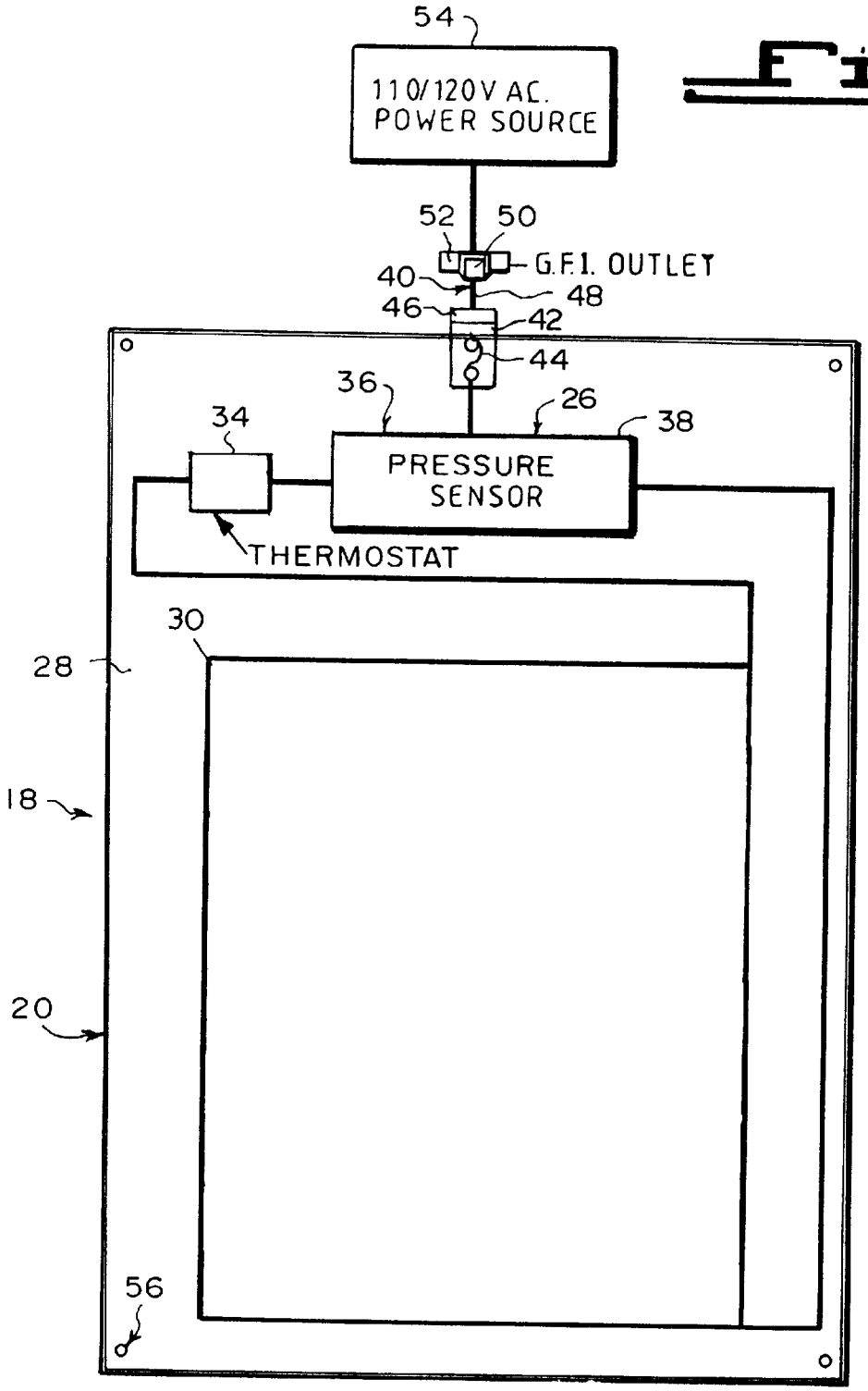
Figure 7A:
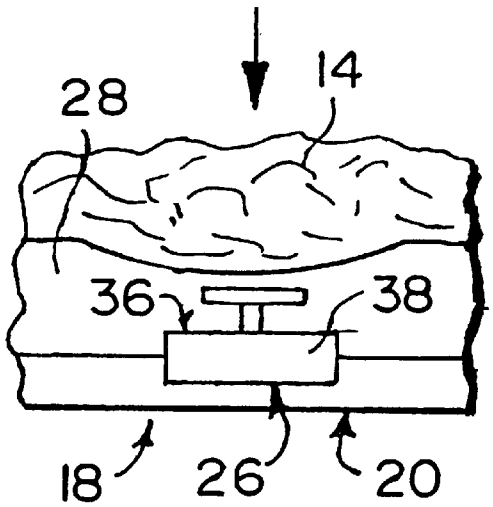
Figure 8:
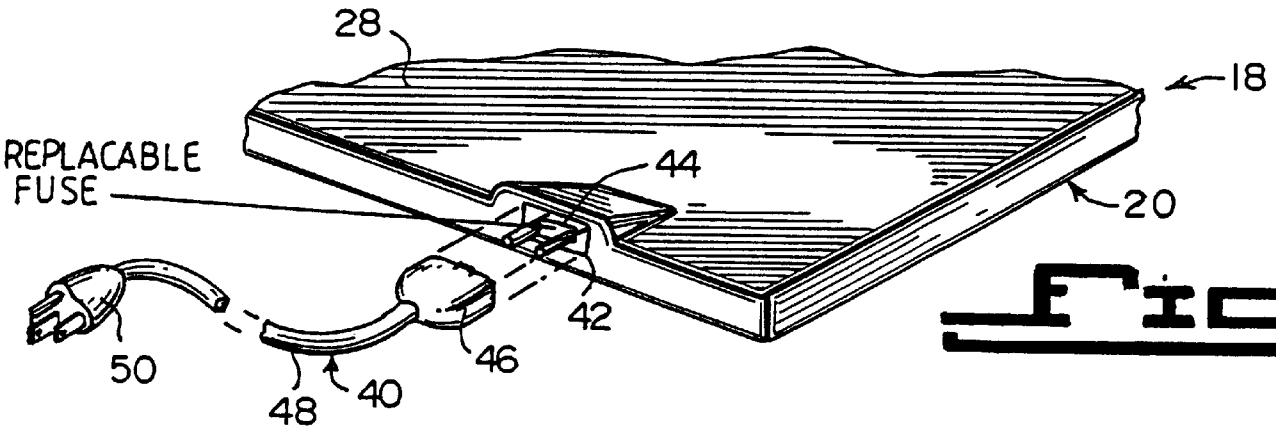

FIG. 2*a* is an enlarged perspective view of the snow and ice melting blanket device of the present invention installed atop a flat roof of a building;

FIG. 2*b* is an exploded perspective view of the platform of the snow and ice melting blanket device of the present invention installed atop a flat roof of a building;

FIG. 2*c* is an enlarged side view of the platform of the snow and ice melting blanket device of the present invention installed atop a flat roof of a building;

FIG. 2*d* is a perspective cross-sectional view of the snow and ice melting blanket device of the present;

FIG. 3 is a perspective view of a house, showing the snow and ice melting blanket device of the present invention installed upon a pitched roof and on a driveway;

FIG. 4 is an enlarged perspective view of the snow and ice melting blanket device of the present invention illustrating the ability of the device to be rolled up for purposes of compact storage;

FIG. 5 is an exploded view with parts broken away and in section, showing an anchor for use in securing the snow and ice melting blanket device of the present invention to a surface;

FIG. 6 is a cross-sectional view of the snow and ice melting blanket device of the present invention taken along line 6—6 in FIG. 4;

FIG. 7 is a diagrammatic top view of the snow and ice melting blanket device of the present invention taken in the direction of arrow 7 in FIG. 4, illustrating the electrical circuit thereof in block diagram form;

FIG. 7A is a cross-sectional view of a section of the snow and ice melting blanket device of the present invention, illustrating the weight of snow or ice activating the pressure sensor within the tarpaulin; and FIG. 8 is a perspective view of a portion of the blanket of the snow and ice melting blanket device of the present invention, showing a replaceable fuse within a male electrical connection plug.

DETAILED DESCRIPTION OF THE PREFERRED EMBODIMENT

Figure 1:
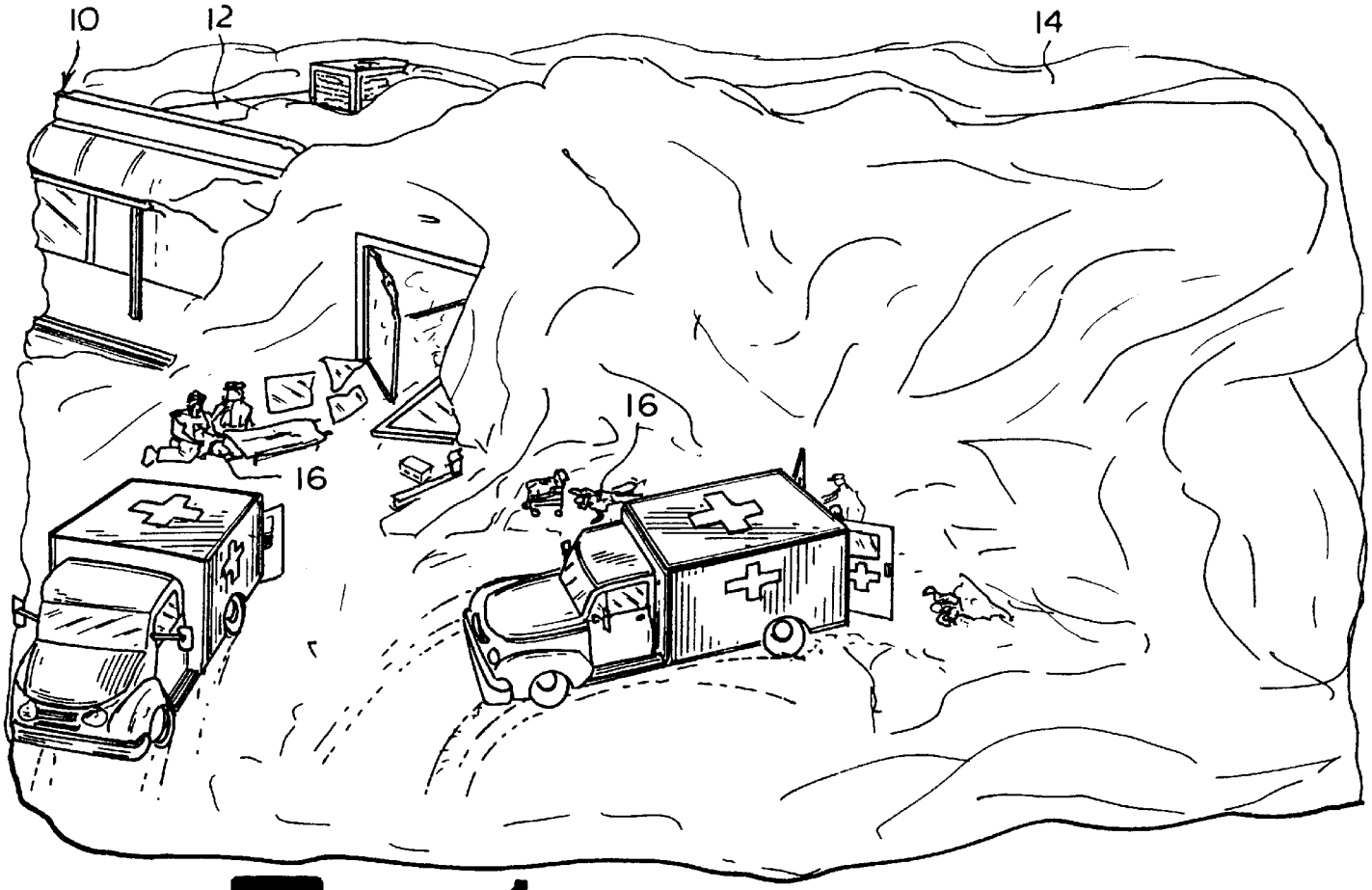
Fig. 1 (PRIOR ART)
FIG. 1 is a perspective view of a roof of a building that has collapsed due to the weight of snow and ice accumulated thereon.

Turning now descriptively to the drawings, in which similar reference characters denote similar elements throughout the several views, FIG. 1 shows a building 10 including a flat roof 12 which has collapsed due to the weight of snow and ice 14 accumulating thereon. The accumulation of snow and ice 14 has caused structural damage to the building 10 and injury to people 16 within and in the vicinity of the building 10. As is evident from this figure, the building 10 did not include any device for removing or relieving the weight of snow and ice on top of the roof 12. Thus, snow and ice 14 was able to accumulate to dangerous levels resulting in an accident causing injury to both the building and persons in the vicinity thereof.

FIGS. 2 through 8 illustrate the snow and ice melting blanket device of the present invention indicated generally by the numeral 18. The snow and ice melting blanket device 18 is shown clearly in FIG. 2 covering a flat top roof 12 of a building 10. The snow and ice melting blanket device 18 includes a tarpaulin 20 sized to cover an exterior surface 22 of the roof 12. A heat generating facility 24 provides an electrical charge to the tarpaulin 20 causing the tarpaulin 20 to heat. A detector 26 for sensing the weight of snow and ice 14 accumulating atop the tarpaulin 20 and comparing the sensed value to a reference value is positioned in a central section of the tarpaulin 20. The detector 26 will activate the heat generating facility 24 to apply an electrical charge to the tarpaulin 20 upon determining the amount of snow and ice 14 sensed atop the roof 12 exceeds the reference value. The application of an electrical charge to the tarpaulin 20 will cause the tarpaulin 20 to heat up, thereby melting the snow and ice 14 accumulating thereon and maintaining the surface 22 of the roof 12 free from snow and ice 14.

A platform 23 may be positioned beneath the tarpaulin 20 causing the sides of the tarpaulin 20 to extend from the sides of the roof 12 at an angle forming a peak along a central section of the roof 12 as is illustrated in FIG. 2. Alternatively, the platform 23 may cause the tarpaulin 20 to form an arced surface. The platform 23 is discussed hereinafter with specific reference to FIGS. 2*a*, 2*b* and 2*c*. The sloping or arcing of the surface of the tarpaulin 20 will cause any snow and ice 14 thereon which is melted by the tarpaulin 20 to flow down along the sides of the tarpaulin 20 due to the force of gravity and collect at the edges. This prevents puddles from forming atop the roof 12 and causing water damage and rotting of the surface of the roof 12. On either side of the platform 23 is a gutter 25 for receiving the melted snow and ice 14 flowing down along the surface of the tarpaulin 20 and directing the melted snow and ice 14 off of the roof 12.

The tarpaulin 20 is generally a substantially rectangular flexible waterproof covering including a top outer layer 28, a bottom outer layer 29 and a middle layer 30 sandwiched therebetween as can be clearly seen from FIGS. 2*d* and 6. The top and bottom outer layers 28 and 29, respectively, are each formed from a lightweight rubber material while the middle layer 30 is formed of a thin sheet of conductive material. The middle layer 30 is flexible so that the tarpaulin 20 can bend to conform with the shape of the platform 23 and also be rolled up providing for compact storage when not in use as will be described hereinafter with specific reference to FIG. 4. A thermostat 34 is electrically connected between the heat generating facility and the control and distribution center 35 which supplies the electrical charge to the heat generating facility 24 and measures the temperature of the tarpaulin 20. The thermostat 34 connects the heat generating facility 24 to the control and distribution facility 35 causing an electrical charge to be applied to the middle layer 30 from the control and distribution facility 35 when the temperature of the tarpaulin 20 reaches a predetermined minimum level. The application of the electrical charge to the conductive middle layer 30 causes the conductive middle layer 30 and thus the tarpaulin 20 to heat up. As the tarpaulin 20 heats up, any snow and/or ice accumulating thereon is caused to melt.

The dimensions of the tarpaulin 20 are adaptable to any size roof 12 including any type of structure thereon. In order to adapt the tarpaulin 20 for placement on a roof 12 such as is illustrated in FIG. 2, a square recess must be cut in the tarpaulin 20 at the position which would be occupied by the air conditioning unit 31 when the tarpaulin 20 is positioned to cover the roof 12. A nonconductive protective layer 33 as illustrated in FIG. 2*d* must then be positioned to surround the surface of the square cut into the tarpaulin 20 to isolate the conductive middle layer 30 from contact with the air conditioning unit 31, the ambient atmosphere and any other debris or elements which may affect its operation.

The preferred form for the platform 23 is illustrated in FIG. 2*a* which shows an enlarged view of the tarpaulin 20 positioned atop the platform 23. As can be seen from this figure, the platform 23 forms an adjustable frame over which the tarpaulin 20 is attached. The platform 23 includes a pair of securing bars 64 which extend in a parallel spaced apart relationship across the width of the roof 12, securing the platform 23 to the sides of the building 10. Extending between the pair of securing bars 64 and defining the distance therebetween are a pair of adjustable bars 66. A pair of clamping devices 68 are each positioned along a respective one of the pair of securing bars 64. The clamping devices 68 each act to secure the tarpaulin 20 to the platform 23 and each includes a gutter 70 positioned thereon for receiving any melted snow and ice flowing down from atop the tarpaulin 20. A pair of flexible supports 72 each extend atop a respective one of the adjustable bars 66 for retaining the tarpaulin 20 thereon. The extent of the arc of the tarpaulin 20 is dependent upon the amount of the bend in the flexible supports 72. The amount of bend in the flexible supports 72 is dependent on the length of the adjustable bars 66.

As can be seen from FIG. 2*b*, the pair of adjustable bars 66 each include a first section 74, a second section 76 and a length adjusting device 78 for combining the first and second sections 74 and 76, respectively, and thereby adjusting the length of the adjustable bar 66. The first section 74 is connected at a first end 80 to the clamping device 68 extending therefrom and including a second end 82 with a thread 84 spiraling therearound along a length of the first section 74. The second section 76 includes a first end for connection to the opposing connecting device 68 and a second hollow end for receiving the threaded second end 82 of the first section 74. The adjusting device 78 is rotatably connected to the second end of the second section 76 for mating with the thread 84 on the second end 82 of the first section 74. As the adjusting device 78 is rotated in the clockwise direction the second end 82 of the first section 74 is drawn further into the hollow second section 76 causing the length of the adjustable bar 66 to decrease and the arc of the flexible supports 72 to increase. As the adjusting device 78 is rotated in the counterclockwise direction the second end 82 of the first section 74 is released from its position extending into the hollow second section 76 causing the length of the adjustable bar 66 to increase and the arc of the flexible supports 72 to decrease or flatten.

The connection between the first section 74 of the adjustable bar 66 and the connecting device 68 is illustrated in FIG. 2*c*. From this figure it is seen that the first section includes a ball 86 on an end thereof which mates with a socket 88 in the connecting device 68. This connection allows the first section 74 to rotate in both the clockwise and counterclockwise directions and thus be drawn into or released from its position within the second section 76.

While a preferred mechanism for adjusting the length of the adjustable bar is shown and described herein, those of ordinary skill in the art who have read this description will appreciate that there are numerous other mechanisms for adjusting the length of the adjustable bar and, therefore, as used herein the phrase "means for adjusting the length of the adjustable bar" should be construed as including all such mechanisms as long as they achieve the desired result of adjusting the length of the adjustable bar, and, therefore, that all such alternative mechanisms are to be considered as equivalent to the one described herein.

A top perspective view of the tarpaulin 20 is illustrated in FIG. 2*d*. From this figure it can be seen that the tarpaulin 20 includes three layers, a top outer layer 28, a bottom outer layer 29 and a middle layer 30 sandwiched between the top and bottom layers 28 and 29, respectively. The middle layer 30 is conductive and extends throughout the entire area of the tarpaulin 20 causing the tarpaulin 20 to be evenly heated throughout when a voltage is applied thereto. When the tarpaulin 20 needs to be positioned over an object on the roof 12 such as the air conditioning unit 31, a recess having an area substantially equal to that of the object may be easily cut into the tarpaulin 20 without effecting the conductiblity of the tarpaulin 20 or its ability to be evenly heated. This is because the middle layer is formed of a conductive substance which extends throughout the entire area of the tarpaulin 20 and may be cut without the possibility of any necessary connections being interrupted or broken. Once the recess is cut, a nonconductive substance must be positioned to cover the cut surface thereby isolating the middle layer from contact with the ambient atmosphere or with the object which will extend through the recess. This will prevent the operation of the tarpaulin 20 from being affected by contact with the object extending through the recess or the ambient atmosphere. Furthermore, the electrically charged conductive middle layer 30 will be prevented from affecting the operation of the object.

The weight detecting component 26 illustrated in FIGS. 2, 4 and 7A is an adjustable pressure sensitive sensor 36, electrically connected to the heat producing facility 24. The sensor 36 is a pressure actuated normally open switch 38, which is caused to close when a predetermined amount of weight, i.e. a predetermined amount of snow and ice 14, accumulates on the top of the tarpaulin 20 (see FIG. 7A). When the predetermined amount of snow and ice 14 causes the switch 38 to close, the heat producing facility 24 will be connected to the power source and an electric charge will be applied to the tarpaulin 20 causing the tarpaulin 20 to heat up and thereby melt the snow and ice 14.

An assembly 40 is provided for supplying electrical power to the heat producing facility 24, through the weight detecting component 26 as illustrated in FIG. 8. The electrical power supply assembly 40 consists of a male plug 42 built into the tarpaulin 20. A replaceable fuse 44 is electrically connected between the male plug 42 and the weight detecting component 26. A female socket 46 engages with the male plug 42. An elongated electric cord 48 is connected at a first end to the female socket 46 and includes a plug 50 connected to a second end thereof for engaging with a wall outlet 52 and thereby carry electricity through the electric cord 48 to the middle layer 30 of the tarpaulin 20.

Elements 56 are provided for securing edges of the tarpaulin 20 to the exterior surface 22 as illustrated in FIG. 4. The securing elements 56 are formed from a plurality of screw anchors 58, which extend through the edges of the tarpaulin 20 and into the exterior surface 22 on which the tarpaulin 20 is positioned. The screw anchors 58 will be removably secured into the exterior surface 22 for removal upon removing the tarpaulin 20 for storage or transport to another area.

Alternatively, the securing elements 56 can consist of a plurality of snap lock sockets 60 mounted into the exterior surface 22 as illustrated in FIG. 5. A plurality of snap lock anchors 62 are attached about the edges of the tarpaulin 20, so that the snap lock anchors 62 can snap into the snap lock sockets 60.

The exterior surface 22 can be a flat roof 10 of a building 12, as shown in FIG. 2, a pitched roof of a house, as shown in FIG. 3 or even a driveway also as shown in FIG. 3. If the exterior surface is a pitched roof or a driveway then the tarpaulin 20 need not be placed atop the platform 23. The platform is not required for this position of the tarpaulin 20 as the pitched roof is already slanted and the driveway is a high traffic area, use of which will be impeded by the presence of the platform 23. However, the operation of the tarpaulin 20 and the snow and ice melting blanket device 18 is the same.

A block diagram of the snow and ice melting blanket device 18 is illustrated in FIG. 7. As can be seen from this figure, the snow and ice melting blanket device 18 is connected to receive power from a power source through an electrical cord 40 detachably connected thereto. A fuse 44 is connected between the connection to the power source 54 and the pressure sensor 26. The pressure sensor 26 is connected to the middle layer 30 of the tarpaulin 20 applying a charge from the power source 54 thereto when activated. The thermostat 34 is also connected to the middle layer 30 of the tarpaulin 20 applying a charge thereto from the power source 54 based upon the measured temperature of the tarpaulin 20.

The operation of the snow and ice melting blanket device 18 will now be described with reference to the figures. In operation, the snow and ice melting blanket device 18 is first unrolled from its storage position for placement on an area in which snow and ice accumulation is desired to be monitored and automatically removed. If the area is a flat roof 12, the platform 23 is set up atop the roof 12 and the adjusting bars 66 are adjusted to the correct spacing to fit the roof 12 and provide the desired arc for the flexible supports 72. The securing bars 64 arc then secured to the building 10 to prevent the platform 23 from moving once set in position. The tarpaulin 20 is now positioned atop the flexible supports 72 and secured to the connecting devices 68 to remain in position. The power supply is now connected to the male plug and the snow and ice melting blanket device 18 is operational. The thermostat 34 is set to the proper temperature to melt the snow and ice 14 which accumulates on the tarpaulin 20 and also to apply an electric charge to the middle layer 30 when the temperature of the tarpaulin 30 falls below a predetermined value. The thermostat 34 will also regulate the temperature of the tarpaulin 20 by controlling the amount of electric charge applied to the middle layer 30 of the tarpaulin 20.

The pressure sensor 26 will now continually monitor the weight of snow and ice accumulating atop the tarpaulin 20 and the thermostat will monitor the temperature of the tarpaulin 20. When either the switch 38 of the pressure sensor 26 is caused to close due to the weight of the snow and ice accumulating on the tarpaulin 20 or the temperature of the tarpaulin 20 falls to a value below the desired value, the power source will be connected to the middle layer 30 of the tarpaulin 20 applying an electric charge thereto and causing the tarpaulin 20 to heat up. As the temperature of the tarpaulin 20 rises any snow and ice accumulating thereon will be caused to melt. As the snow and ice melts it will flow down the arced sides of the tarpaulin 20 and into the gutters 70 at the edges of the tarpaulin 20. The gutters 70 will collect the melted snow and ice and direct it to flow off of the roof 12 to prevent any possible damage which may be caused by the accumulation of puddles on the roof 12.

Once the weather warms and it is no longer desired to monitor and regulate the accumulation of snow and ice on the roof 12, the tarpaulin 20 can be disconnected from the platform 23 and removed from its position atop the roof 12. The tarpaulin 20 can then be rolled up for convenient storage until needed again.

From the above description it can be seen that the snow and ice melting blanket device of the present invention is able to overcome the shortcomings of prior art devices by providing a snow and ice melting blanket device able to be placed atop a flat roof of a building for melting and removing any snow and/or ice accumulating thereon and including a platform providing a slanted or arced surface on which the tarpaulin is to be placed and along which any melted liquid will flow due to the force of gravity for eventual collection and removal. The snow and ice melting blanket device also includes a gutter positioned on either side of the platform for receiving the melted liquid flowing along the blanket surface and directing the liquid away from the roof surface. The snow and ice melting blanket device is also able to protect and extend the life of the surface of a roof by removing the melted snow and ice therefrom thereby avoiding any possibility of the melted snow and ice leaking through the rooftop or providing excess weight atop the roof. Furthermore, the snow and ice melting blanket device of the present invention is simple and easy to use and economical in cost to manufacture.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is new and desired to be protected by Letters Patent is set forth in the appended claims:

1. A snow and ice melting blanket device positioned on a surface and connected to a power source for melting snow and ice accumulating atop the surface, said snow and ice melting blanket device comprising:

a) a tarpaulin including a top layer, a bottom layer and a third middle layer positioned between said top layer and said bottom layer, said middle layer including a heating element extending therethrough and being flexible allowing said tarpaulin to conform to a terrain of the surface desired to be maintained free of accumulating snow and ice;

b) means for sensing a temperature of said tarpaulin; and c) means connected between said said heating element of said middle layer and the power source for sensing a weight of snow and ice accumulated atop said tarpaulin, and d) a platform having a top side, said tarpaulin being positioned on said top side of said platform and said top side of said platform being arced causing said tarpaulin to form an arc whereby any snow and ice melted by said tarpaulin to flow down along and off of said tarpaulin, wherein said means for sensing pressure is a pressure activated switch for connecting the power source to supply an electrical charge to said heating element upon sensing a predetermined weight of snow and ice accumulated atop said tarpaulin causing said heating element and said tarpaulin to heat up and melt the accumulated snow and ice thereby keeping said tarpaulin free of snow and ice.

2. The snow and ice melting blanket as recited in claim 1, wherein said top and bottom layers are formed of a flexible waterproof covering.

3. The snow and ice melting blanket as recited in claim 1, wherein said means for sensing said temperature is a thermostat, said thermostat controlling an amount of electrical charge applied by the power source to said middle layer thereby controlling a temperature of said tarpaulin.

4. The snow and ice melting blanket device as recited in claim 1, wherein said platform includes first and second width sides and said device further includes first and second clamping means each positioned on a respective one of said first and second width sides for receiving and holding a respective side of said tarpaulin.

5. The snow and ice melting blanket device as recited in claim 4, wherein said platform includes first and second length sides extending between said first and second width sides.

6. The snow and ice melting blanket device as recited in claim 5, wherein said first and second width sides are adjustable and said platform further comprises means for adjusting a length of said first and second length sides.

7. The snow and ice melting blanket device as recited in claim 6, further comprising first and second gutters, each positioned along a respective one of said first and second width sides for receiving melted snow and ice flowing down along and off of said tarpaulin and directing the received melted snow and ice away from the surface.

8. The snow and ice melting blanket device as recited in claim 1, wherein said pressure actuated switch is a normally open switch, said switch being caused to close upon accumulation of a predefined weight thereon.

9. The snow and ice melting blanket device as recited in claim 1, further including means for securing said tarpaulin to the surface.

10. The snow and ice melting blanket device as recited in claim 9, wherein said securing means includes a plurality of screw anchors extending through said tarpaulin and into the surface.

11. The snow and ice melting blanket device as recited in claim 9, wherein said securing means includes:

a) a plurality of snap lock sockets mounted into the surface; and b) a plurality of snap lock anchors attached to said tarpaulin, wherein said snap lock anchors snap and releasably connect to said snap lock sockets.

* * * * *